US009494294B2

(12) United States Patent
Edmond et al.

(10) Patent No.: US 9,494,294 B2
(45) Date of Patent: Nov. 15, 2016

(54) MODULAR INDIRECT TROFFER

(75) Inventors: Mark D. Edmond, Raleigh, NC (US); Paul Kenneth Pickard, Morrisville, NC (US); Larry T. Scearce, Jr., Durham, NC (US); James Michael Lay, Cary, NC (US); Praneet Athalye, Morrisville, NC (US)

(73) Assignee: CREE, INC., Durham, NC (US)

( * ) Notice: Subject to any disclaimer, the term of this patent is extended or adjusted under 35 U.S.C. 154(b) by 156 days.

(21) Appl. No.: 13/429,080

(22) Filed: Mar. 23, 2012

(65) Prior Publication Data

US 2013/0250567 A1 Sep. 26, 2013

(51) Int. Cl.

| | |
|---|---|
| ***F21V 13/14*** | (2006.01) |
| ***F21V 7/00*** | (2006.01) |
| ***F21V 29/71*** | (2015.01) |
| ***F21V 29/00*** | (2015.01) |
| ***F21S 8/02*** | (2006.01) |
| ***F21S 8/06*** | (2006.01) |
| *F21Y 101/02* | (2006.01) |

(Continued)

(52) U.S. Cl.

CPC ..... *F21V 7/0008* (2013.01); *F21S 8/026* (2013.01); *F21S 8/06* (2013.01); *F21V 29/006* (2013.01); *F21V 29/717* (2015.01); *F21Y 2101/02* (2013.01); *F21Y 2111/007* (2013.01); *F21Y 2113/005* (2013.01)

(58) Field of Classification Search

None

See application file for complete search history.

(56) References Cited

U.S. PATENT DOCUMENTS

| | | | | |
|---|---|---|---|---|
| D85,382 | S | 10/1931 | Guth | D26/24 |
| 2,356,654 | A | 8/1944 | Cullman | 200/84 C |
| 3,381,124 | A | 4/1968 | Eisenberg | 362/354 |

(Continued)

FOREIGN PATENT DOCUMENTS

| | | |
|---|---|---|
| CN | 1762061 | 4/2006 |
| CN | 1934389 | 3/2007 |

(Continued)

OTHER PUBLICATIONS

Office Action from Japanese Design Patent Application No. 2011-18570.

(Continued)

*Primary Examiner* — Britt D Hanley

(74) *Attorney, Agent, or Firm* — Koppel, Patrick, Heybl & Philpott

(57) ABSTRACT

A modular troffer-style lighting fixture. The fixture is particularly well-suited for use with solid state light sources, such as LEDs. Embodiments comprise a pan structure designed to house one or more modular light engine units within a central opening. Each light engine unit includes a reflective cup that can house several light sources on an interior mount surface. The cup is positioned proximate to a back reflector such that its open end faces a portion of the back reflector. The back reflector is shaped to define an interior chamber where light can be mixed and redirected. At least one elongated leg extends away from the reflective cup toward an edge of said back reflector. The leg(s) are used to mount the reflective cup relative to the back reflector and may also be used as a heat sink and/or an additional mount surface for light sources.

42 Claims, 7 Drawing Sheets

(51) Int. Cl.
*F21Y 111/00* (2016.01)
*F21Y 113/00* (2016.01)

(56) References Cited

U.S. PATENT DOCUMENTS

| | | | | |
|---|---|---|---|---|
| 4,939,627 | A | 7/1990 | Herst et al. | 362/299 |
| 5,025,356 | A | 6/1991 | Gawad | 362/221 |
| 5,526,190 | A | 6/1996 | Hubble, III | 347/102 |
| 5,823,663 | A | 10/1998 | Bell et al. | 362/362 |
| D407,473 | S | 3/1999 | Wimbock | D23/328 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,443,598 | B1 | 9/2002 | Morgan | 362/342 |
| 6,523,974 | B2 | 2/2003 | Engel | 362/224 |
| 6,578,979 | B2 | 6/2003 | Truttmann-Battig | 362/92 |
| 6,598,998 | B2 | 7/2003 | West | 257/E33.073 |
| D496,121 | S | 9/2004 | Santoro | D26/74 |
| 6,871,983 | B2 | 3/2005 | Jacob et al. | 362/364 |
| 6,948,838 | B2 | 9/2005 | Kunstler | 362/237 |
| 6,948,840 | B2 | 9/2005 | Grenda et al. | 362/555 |
| 6,951,415 | B2 | 10/2005 | Amano | 362/297 |
| 7,021,797 | B2 | 4/2006 | Minano et al. | 362/355 |
| 7,049,761 | B2 | 5/2006 | Timmermans et al. | 315/246 |
| 7,063,449 | B2 | 6/2006 | Ward | 345/102 |
| 7,111,969 | B2 | 9/2006 | Bottesch | 362/299 |
| 7,175,296 | B2 | 2/2007 | Cok | 362/147 |
| 7,213,940 | B1 | 5/2007 | Van de Ven et al. | 362/231 |
| 7,217,004 | B2 | 5/2007 | Park | 362/240 |
| 7,237,924 | B2 | 7/2007 | Martineau et al. | 362/231 |
| D556,358 | S | 11/2007 | Santoro | D26/74 |
| 7,338,182 | B1 * | 3/2008 | Hastings et al. | 362/150 |
| 7,341,358 | B2 | 3/2008 | Hsieh | 362/97.1 |
| 7,510,299 | B2 | 3/2009 | Timmermans et al. | 362/225 |
| 7,520,636 | B2 | 4/2009 | Van der Poel | 362/290 |
| D593,246 | S | 5/2009 | Fowler et al. | D26/76 |
| 7,559,672 | B1 | 7/2009 | Parkyn et al. | 362/244 |
| 7,594,736 | B1 | 9/2009 | Kassay et al. | 362/223 |
| D604,446 | S | 11/2009 | Fowler et al. | D26/76 |
| 7,618,157 | B1 | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,702 | B1 | 2/2010 | Ding et al. | 362/294 |
| 7,661,844 | B2 | 2/2010 | Sekiguchi et al. | 362/249 |
| D611,183 | S | 3/2010 | Duarte | D26/76 |
| 7,674,005 | B2 | 3/2010 | Chung et al. | 362/223 |
| 7,686,470 | B2 | 3/2010 | Chiang | 362/147 |
| 7,686,484 | B2 | 3/2010 | Heiking et al. | 362/375 |
| 7,712,918 | B2 | 5/2010 | Siemiet et al. | 362/241 |
| 7,722,220 | B2 | 5/2010 | Van de Ven | 362/294 |
| 7,722,227 | B2 | 5/2010 | Zhang et al. | 362/364 |
| D617,487 | S | 6/2010 | Fowler et al. | D26/76 |
| 7,768,192 | B2 | 8/2010 | Van de Ven et al. | 313/503 |
| 7,815,338 | B2 | 10/2010 | Siemiet et al. | 362/218 |
| 7,828,468 | B2 | 11/2010 | Mayfield et al. | 362/342 |
| D633,247 | S | 2/2011 | Kong et al. | D26/88 |
| 7,922,354 | B2 | 4/2011 | Everhart | 362/235 |
| 7,926,982 | B2 | 4/2011 | Liu | 362/294 |
| 7,988,321 | B2 | 8/2011 | Wung et al. | 362/218 |
| 7,988,335 | B2 | 8/2011 | Liu et al. | 362/294 |
| 7,991,257 | B1 | 8/2011 | Coleman | 264/1.24 |
| 7,993,034 | B2 | 8/2011 | Wegner | 362/296.05 |
| 7,997,762 | B2 | 8/2011 | Wang et al. | 362/249 |
| 8,038,314 | B2 | 10/2011 | Ladewig | |
| 8,070,326 | B2 | 12/2011 | Lee | 362/337 |
| D653,376 | S | 1/2012 | Kong et al. | D26/76 |
| 8,092,043 | B2 | 1/2012 | Lin et al. | 362/249.02 |
| 8,092,049 | B2 | 1/2012 | Kinnune et al. | 362/294 |
| 8,096,671 | B1 | 1/2012 | Cronk | 362/147 |
| D657,488 | S | 4/2012 | Lown et al. | D26/120 |
| 8,162,504 | B2 | 4/2012 | Zhang et al. | 362/217 |
| 8,186,855 | B2 | 5/2012 | Wassel et al. | 362/373 |
| 8,197,086 | B2 | 6/2012 | Watanabe et al. | 362/218 |
| 8,201,968 | B2 | 6/2012 | Maxik et al. | |
| 8,215,799 | B2 | 7/2012 | Vanden Eynden et al. | 362/294 |
| 8,246,219 | B2 | 8/2012 | Teng | 362/217.02 |
| 8,256,927 | B2 | 9/2012 | Hu | 362/218 |
| D670,849 | S | 11/2012 | Lay et al. | D26/74 |
| 8,317,354 | B2 | 11/2012 | Gassner et al. | 362/147 |
| D679,848 | S | 4/2013 | Pickard et al. | D26/74 |
| 8,410,514 | B2 | 4/2013 | Kim | 257/99 |
| D684,291 | S | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,556,452 | B2 | 10/2013 | Simon | 362/217.07 |
| 8,591,058 | B2 | 11/2013 | Concepcion | 362/231 |
| 8,591,071 | B2 | 11/2013 | Hochstein | 362/294 |
| 8,602,601 | B2 | 12/2013 | Khazi | 362/249.02 |
| 8,616,723 | B2 | 12/2013 | Zhang | 362/218 |
| D698,975 | S | 2/2014 | Blessitt et al. | D26/74 |
| 8,641,243 | B1 | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 | 4/2014 | Rashidi | 362/147 |
| 8,764,244 | B2 | 7/2014 | Jeon | 362/218 |
| D714,988 | S | 10/2014 | Park et al. | D26/74 |
| D721,198 | S | 1/2015 | Glasbrenner | D26/76 |
| 9,052,075 | B2 | 6/2015 | Demuynck et al. | |
| 2003/0063476 | A1 | 4/2003 | English et al. | |
| 2004/0001344 | A1 | 1/2004 | Hecht | 362/555 |
| 2004/0085779 | A1 | 5/2004 | Pond et al. | 362/516 |
| 2004/0100796 | A1 | 5/2004 | Ward | |
| 2004/0240230 | A1 | 12/2004 | Kitajima | 362/558 |
| 2005/0180135 | A1 | 8/2005 | Mayer | 362/240 |
| 2005/0264716 | A1 | 12/2005 | Kim et al. | |
| 2005/0281023 | A1 | 12/2005 | Gould | 362/217 |
| 2006/0221611 | A1 | 10/2006 | No | 362/247 |
| 2006/0262521 | A1 | 11/2006 | Piepgras et al. | 362/149 |
| 2006/0291206 | A1 | 12/2006 | Angelini et al. | 362/244 |
| 2007/0070625 | A1 | 3/2007 | Bang | 362/240 |
| 2007/0109779 | A1 | 5/2007 | Sekiguchi et al. | |
| 2007/0115670 | A1 | 5/2007 | Roberts et al. | |
| 2007/0115671 | A1 | 5/2007 | Roberts et al. | |
| 2007/0211457 | A1 | 9/2007 | Mayfield et al. | 362/223 |
| 2007/0253205 | A1 | 11/2007 | Welker | 362/373 |
| 2007/0297181 | A1 | 12/2007 | Mayfield et al. | 362/342 |
| 2008/0019147 | A1 | 1/2008 | Erchak | 362/607 |
| 2008/0049422 | A1 | 2/2008 | Trenchard et al. | 362/238 |
| 2008/0232093 | A1 | 9/2008 | Kim | 362/147 |
| 2008/0278943 | A1 * | 11/2008 | Van Der Poel | 362/240 |
| 2009/0034247 | A1 | 2/2009 | Boyer | 362/225 |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0225543 | A1 | 9/2009 | Jacobson et al. | |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2009/0323334 | A1 | 12/2009 | Roberts et al. | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0172133 | A1 | 7/2010 | Liu | 362/235 |
| 2010/0177532 | A1 | 7/2010 | Simon et al. | 362/555 |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0277905 | A1 | 11/2010 | Janik et al. | 362/235 |
| 2010/0277934 | A1 | 11/2010 | Oquendo, Jr. | 362/433 |
| 2010/0295468 | A1 | 11/2010 | Pedersen et al. | 315/294 |
| 2010/0327768 | A1 | 12/2010 | Kong et al. | 315/294 |
| 2011/0032714 | A1 | 2/2011 | Chang | 362/373 |
| 2011/0043132 | A1 * | 2/2011 | Kim et al. | 362/235 |
| 2011/0090671 | A1 | 4/2011 | Bertram et al. | 362/84 |
| 2011/0141722 | A1 | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0164417 | A1 | 7/2011 | Huang | 362/235 |

(56) References Cited

U.S. PATENT DOCUMENTS

| | | | | |
|---|---|---|---|---|
| 2011/0175533 | A1 | 7/2011 | Holman | 315/130 |
| 2011/0199005 | A1 | 8/2011 | Bretschneider et al. | |
| 2011/0199769 | A1 | 8/2011 | Bretschneider et al. | |
| 2011/0246146 | A1 | 10/2011 | Kauffman et al. | 703/2 |
| 2011/0255292 | A1 | 10/2011 | Shen | 362/311 |
| 2011/0267810 | A1 | 11/2011 | Higman et al. | 362/218 |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Pickard | |
| 2013/0235568 | A1 | 9/2013 | Green et al. | 362/218 |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | |
|---|---|---|---|
| CN | 1963289 | A | 5/2007 |
| CN | 101188261 | | 5/2008 |
| CN | 101776254 | | 7/2010 |
| CN | 101776254 | A | 7/2010 |
| CN | 101790660 | | 7/2010 |
| CN | 101790660 | A | 7/2010 |
| CN | 202580962 | | 12/2012 |
| DE | 102007030186 | | 1/2009 |
| DE | 202010001832 | | 7/2010 |
| EP | 1298383 | A2 | 4/2003 |
| EP | 1357335 | A2 | 10/2003 |
| EP | 1653254 | | 5/2006 |
| EP | 1737051 | | 12/2006 |
| EP | 1847762 | A2 | 10/2007 |
| EP | 1860467 | | 11/2007 |
| EP | 2287520 | A2 | 2/2011 |
| EP | 2290690 | A2 | 3/2011 |
| EP | 2636945 | A2 | 11/2013 |
| GB | 774198 | | 5/1957 |
| JP | 1069809 | | 3/1998 |
| JP | 2002244027 | | 11/2002 |
| JP | U3097327 | | 8/2003 |
| JP | 2004140327 | | 5/2004 |
| JP | 2004345615 | | 12/2004 |
| JP | 2004345615 | A | 12/2004 |
| JP | 2006173624 | | 6/2006 |
| JP | 2008147044 | | 6/2008 |
| JP | 3151501 | U | 6/2009 |
| JP | 2009295577 | | 12/2009 |
| JP | 2010103687 | | 5/2010 |
| JP | 2011018571 | | 8/2011 |
| JP | 2011018572 | | 8/2011 |
| TW | 200524186 | | 7/2005 |
| TW | 200524186 | A | 7/2005 |
| TW | 200914759 | A | 4/2009 |
| TW | 201018826 | | 5/2010 |
| TW | 201018826 | A | 5/2010 |
| WO | WO03102467 | | 11/2003 |
| WO | WO2009030233 | | 3/2009 |
| WO | WO2009140461 | A1 | 11/2009 |
| WO | WO2009157999 | | 12/2009 |
| WO | WO2009157999 | A | 12/2009 |
| WO | WO2009157999 | A1 | 12/2009 |
| WO | WO2010024583 | | 3/2010 |
| WO | WO2010024583 | A2 | 3/2010 |
| WO | WO2010042216 | | 4/2010 |
| WO | WO2010042216 | A2 | 4/2010 |
| WO | WO2011140353 | A2 | 1/2011 |
| WO | WO2011074424 | A1 | 6/2011 |
| WO | WO2011096098 | A1 | 8/2011 |
| WO | WO2011098191 | | 8/2011 |
| WO | WO2011118991 | A2 | 9/2011 |
| WO | WO03102467 | | 12/2013 |

OTHER PUBLICATIONS

Reason for Rejection from Japanese Design Patent Application No. 2011-18571.
Reason for Rejection from Japanese Design Patent Application No. 2011-18572.
Notice to Submit a Response from Korean Patent Application No. 30-2011-0038115. dated Dec. 12. 2012.
Notice to Submit a Response from Korean Patent Application No. 30-2011-0038116, dated Dec. 12. 2012.
Preliminary Report and Written Opinion from PCT appl No. PCT/US2012/047084, dated Feb, 6, 2014.
U.S. Appl. No. 12/873.303, filed Aug. 31, 2010 to Edmond, et al.
U.S. Appl. No. 12/961.385, filed Dec. 6, 2010 to Pickard, et al.
Cree's XLamp XP-E LED's, data sheet, pp. 1-16.
Cree's XLamp XP-G LED's, data sheet, pp. 1-12.
International Search Report and Written Opinion for Patent Application No. PCT/US2011/001517, dated: Feb. 27, 2012.
International Search Report and Written Opinion for PCT Application No. PCT/US2011/062396, dated Jul. 13, 2012.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
International Search Report and Written Opinion from PCT/US2013/049225, dated Oct. 24, 2013.
Final Rejection issued in Korean Design Appl. No. 30-2011-0038114, dated Jun. 14, 2013.
Final Rejection issued in Korean Design Appl. No. 30-2011-0038115, dated Jun. 14, 2013.
Final Rejection issued in Korean Design Appl. No. 30-2011-0038116, dated Jun. 17, 2013.
International Search Report and Written Opinion from PCT Patent Appl. No. PCT/U52013/035668, dated Jul. 12, 2013.
International Search Report and Written Opinion from PCT Application No. PCT/US2013/021053, dated Apr. 17, 2013.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
International Search Report and Written Opinion from Appl. No. PCT/CN2013/072772, dated Dec. 19, 2013.
Office Action from U.S. Appl. No. 29/387,171, dated May 2, 2012.
Response to OA from U.S. Appl. No. 29/387,171, filed Aug. 2, 2012.
Office Action from U.S. Appl. No. 12/961,385, dated Apr. 26, 2013.
Response to CA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Jun. 24, 2012.
Response to OA from U.S. Appl. No. 29/368,970, filed Nov. 26, 2012.
Reasons for Rejection from Japanese Patent Appl. No. 2013-543207, dated May 20. 2014.
First Office Action from Chinese Patent Appl. No. 2011800529984, dated May 4. 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341.741, dated Jun. 6, 2014.
Office Action from U.S. Appl. No. 12/961,385, dated Mar. 11, 2014.
Office Action from U.S. Appl. No. 13/464,745, dated Jul. 16, 2014.
International Preliminary Report on Patentability and Written Opinion from PCT/US2013/021053, dated Aug. 21, 2014.
Communication from European Patent Appl. No. 13701525.1-1757, dated Sep. 26, 2014.
International Preliminary Report on Patentabiliby from PCT/US2012/071800 dated Jul. 10, 2014.
Office Action from U.S. Appl. No. 13/189,535, dated Jun. 20, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/442,746, dated Sep. 15, 2014.
Office Action from U.S. Appl. No. 13/844,431, dated Oct. 10, 2014.
Office Action from U.S. Appl. No. 13/443,630, dated Oct. 10, 2014.

(56) References Cited

OTHER PUBLICATIONS

Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl. No. 13701525.1-1757, dated Nov. 24, 2014.
Preliminary Report on Patentability from PCT/US2013/035668, dated Oct. 14. 2014.
Second Office Action and Search Report from Chinese Appl. No. 2011800529984, dated Dec. 26. 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
Office Action from U.S. Appl. No. 13/189,535, dated Jan. 13, 2015.
Office Action from U.S. Appl. No. 13/787,727, dated Jan. 29, 2015.
Office Action from U.S. Appl. No. 13/453,924, dated Mar. 10, 2015.
First Official Action from European Patent Appl. No. 12 743 003.1-1757, dated Jan. 16, 2015.
Office Action from U.S. Appl. No. 14/716,980, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 201180058877D, dated Sep. 25, 2015.
Examination Report from Taiwanese Patent Appl. No. 100131021, dated Jan. 5, 2016.
Examination from European Patent Appl. No. 12743003.1-1757, dated Jan. 8, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action from U.S. Appl. No. 13/189,535; Jan. 6, 2016.
Office Action from U.S. Appl. No. 13/341,741; Jan. 8, 2016.
Office Action from U.S. Appl. No. 13/873,303; Feb. 2, 2016.
Office Action from U.S. Appl. No. 13/464,745; Mar. 1, 2016.
Office Action from U.S. Appl. No. 14/716,480; Mar. 3, 2016.
Office Action from U.S. Appl. No. 13/368,217; Mar. 4, 2016.
Office Action from U.S. Appl. No. 13/189,535; Mar. 18, 2016.
Office Action from U.S. Appl. No. 14/020,757; Apr. 7, 2016.
Office Action from U.S. Appl. No. 29/466,391; May 10, 2016.
Second Office Action for Application No. 2011800588770; Dated Mar. 29, 2016.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/189,535, dated Jul. 14, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Office Action for U.S. Appl. No. 11/828,348; Dated Jun. 2, 2016.
Notice of Reason for Rejection for Japanese Appl. No. 2013-543207; Dated May 24, 2016.
Office Action for U.S. Appl. No. 14/020,757; Dated Jul. 19, 2016.
Examination Report from Taiwan Application No. 100131021; Dated Jul. 21, 2016.
Office Action for U.S. Appl. No. 14/716,480; Dated Aug. 26, 2016.
European Summons for Oral Proceedings for Application No. 12743003.1; Dated Sep. 2, 2016.
Office Action for U.S. Appl. No. 13/464,745; Dated Sep. 7, 2016.

* cited by examiner

FIG. 1
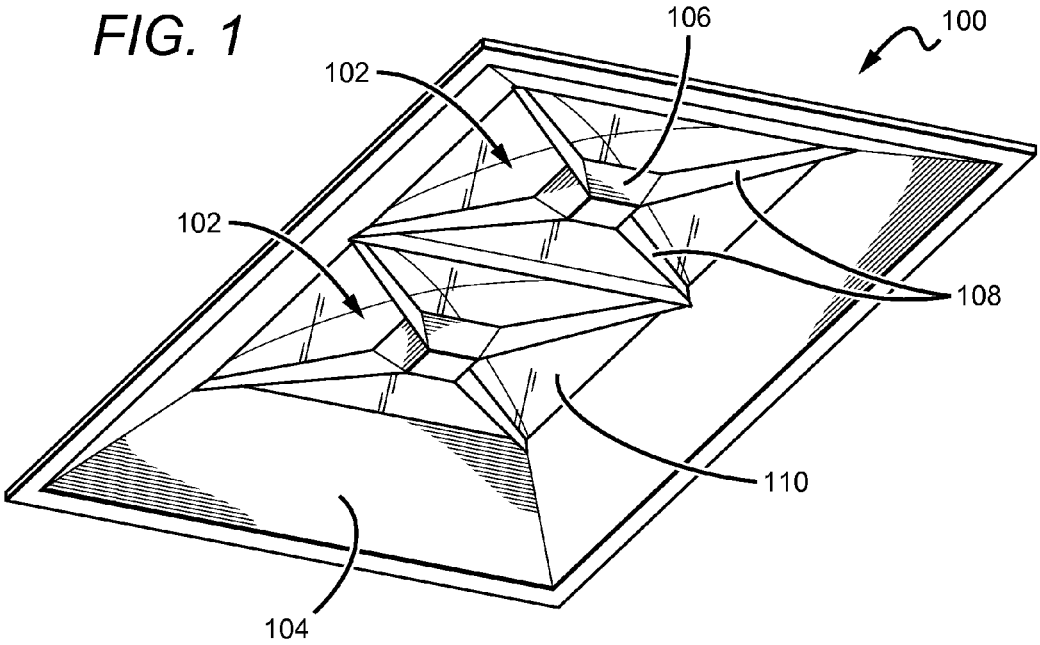
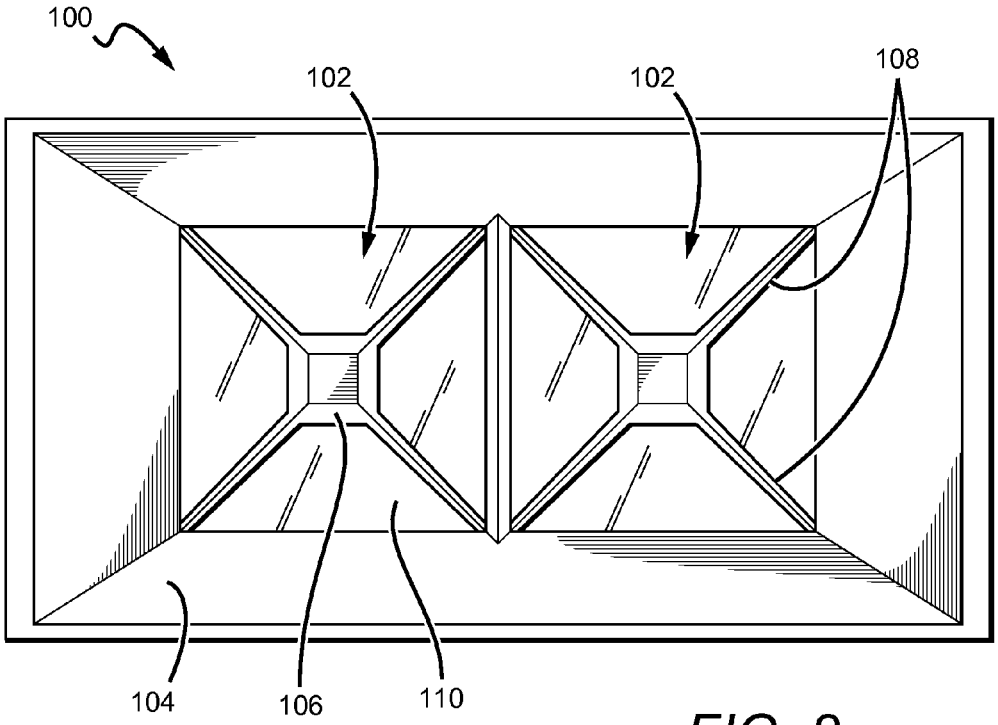
FIG. 2

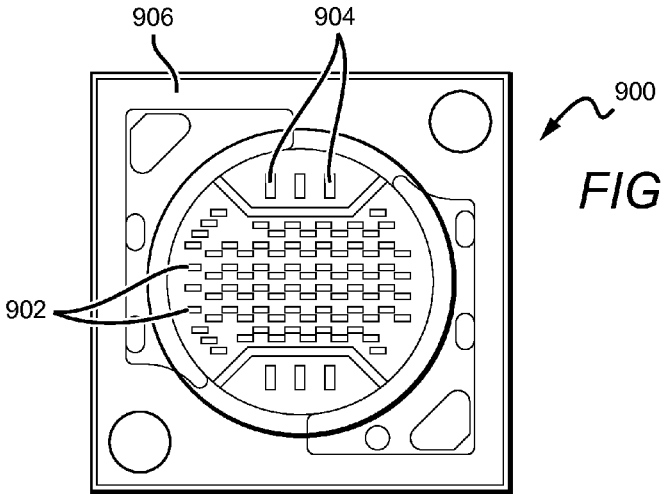
FIG. 9
FIG. 10
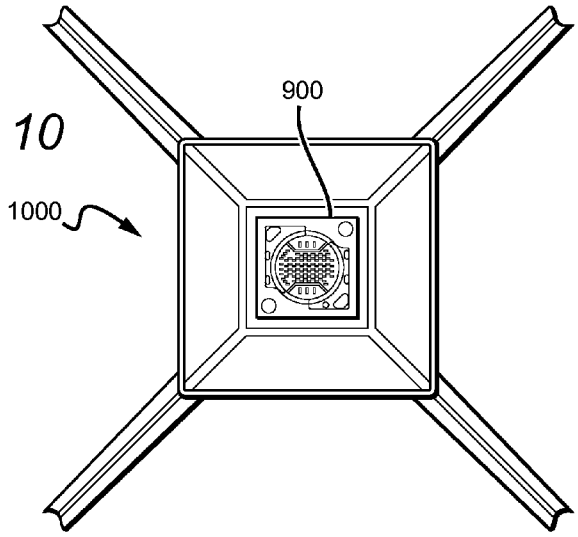
FIG. 11
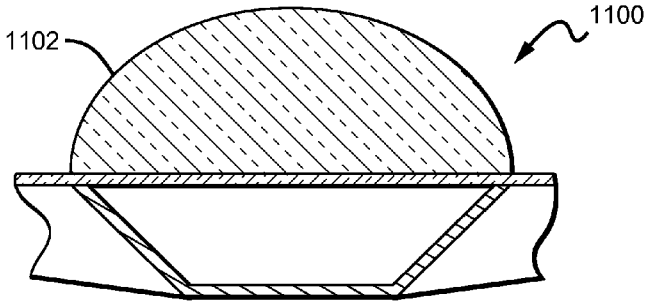

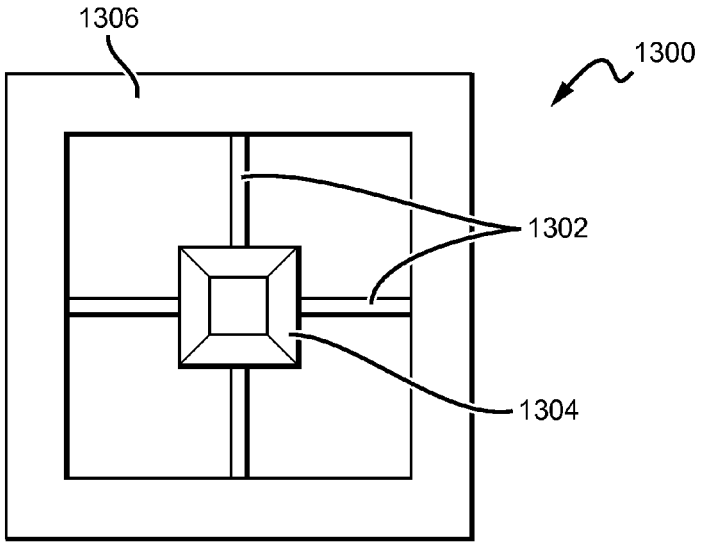
FIG. 13
FIG. 14
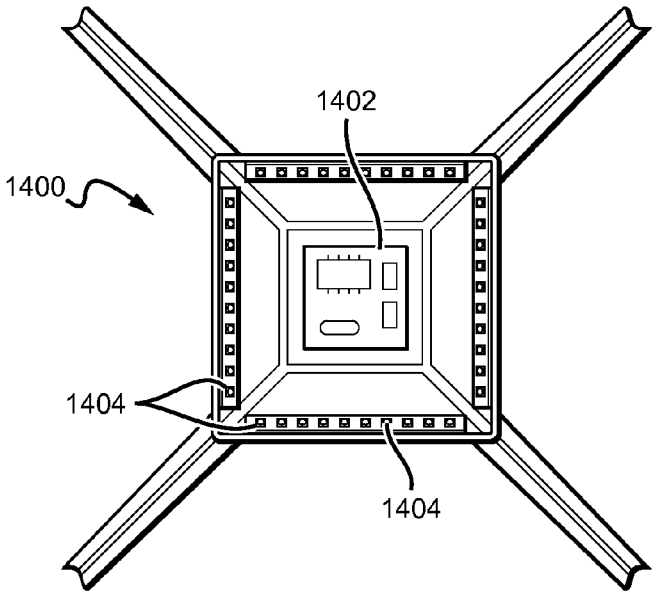

MODULAR INDIRECT TROFFER

BACKGROUND OF THE INVENTION

1. Field of the Invention

The invention relates to lighting troffers and, more particularly, to modular indirect lighting troffers that are well-suited for use with solid state lighting sources, such as light emitting diodes (LEDs).

2. Description of the Related Art

Troffer-style fixtures are ubiquitous in commercial, office, and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example. LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Because of the physical arrangement of the various source elements, multicolor sources often cast shadows with color separation and provide an output with poor color uniformity. For example, a source featuring blue and yellow sources may appear to have a blue tint when viewed head on and a yellow tint when viewed from the side. Thus, one challenge associated with multicolor light sources is good spatial color mixing over the entire range of viewing angles. One known approach to the problem of color mixing is to use a diffuser to scatter light from the various sources.

Another known method to improve color mixing is to reflect or bounce the light off of several surfaces before it is emitted from the lamp. This has the effect of disassociating the emitted light from its initial emission angle. Uniformity typically improves with an increasing number of bounces, but each bounce has an associated optical loss. Some applications use intermediate diffusion mechanisms (e.g., formed diffusers and textured lenses) to mix the various colors of light. Many of these devices are lossy and, thus, improve the color uniformity at the expense of the optical efficiency of the device.

Many current luminaire designs utilize forward-facing LED components with a specular reflector disposed behind the LEDs. One design challenge associated with multi-source luminaires is blending the light from LED sources within the luminaire so that the individual sources are not visible to an observer. Heavily diffusive elements are also used to mix the color spectra from the various sources to achieve a uniform output color profile. To blend the sources and aid in color mixing, heavily diffusive exit windows have been used. However, transmission through such heavily diffusive materials causes significant optical loss.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY OF THE INVENTION

Embodiments of a light engine unit comprise the following elements. A reflective cup includes an interior mount surface. A back reflector is proximate to the reflective cup, with at least a portion of the back reflector facing the mount surface. The back reflector is shaped to define an interior chamber. At least one elongated leg extends away from the reflective cup toward an edge of the back reflector.

Embodiments of a light fixture comprise the following elements. A pan structure defines a central opening. A light engine unit is sized to fit within the central opening with the light engine comprising the following elements. A reflective cup includes an interior mount surface. A back reflector is proximate to the reflective cup, at least a portion of the back reflector facing the mount surface. The back reflector is shaped to define an interior chamber. A plurality of elongated legs extending away from the reflective cup toward the pan. A plurality of light emitting diodes (LEDs) is on the reflective cup mount surface, the LEDs aimed to emit toward the back reflector. A control circuit is included for controlling the LEDs.

A modular light fixture comprises the following elements. A pan structure defines a central opening. A plurality of light engine units is sized to removably mount within the central opening, each of the light engines comprising the following elements. A reflective cup comprises an interior mount surface. A back reflector is proximate to the reflective cup, at least a portion of the back reflector faces the mount surface. The back reflector is shaped to define an interior chamber. At least one elongated leg extends away from said reflective cup toward an edge of said back reflector.

BRIEF DESCRIPTION OF THE DRAWINGS

FIG. 1 is a perspective view from a bottom side angle of a fixture according to an embodiment of the present invention.

FIG. 2 is a perspective view from the bottom side of a fixture according to an embodiment of the present invention.

FIG. 9 is a top perspective view of a chip-on-board element that may be used in fixtures according to embodiments of the present invention.

FIG. 10 is a top perspective view of a reflective cup that may be used in fixtures according to embodiments of the present invention.

FIG. 11 is a cross-sectional view of a reflective cup that may be used in fixtures according to embodiments of the present invention.

FIG. 13 is a top perspective view of a light engine that may be used in fixtures according to embodiments of the present invention.

FIG. 14 is a top perspective view of a light engine unit that may be used in fixtures according to embodiments of the present invention.

DETAILED DESCRIPTION OF THE INVENTION

Figure 3:
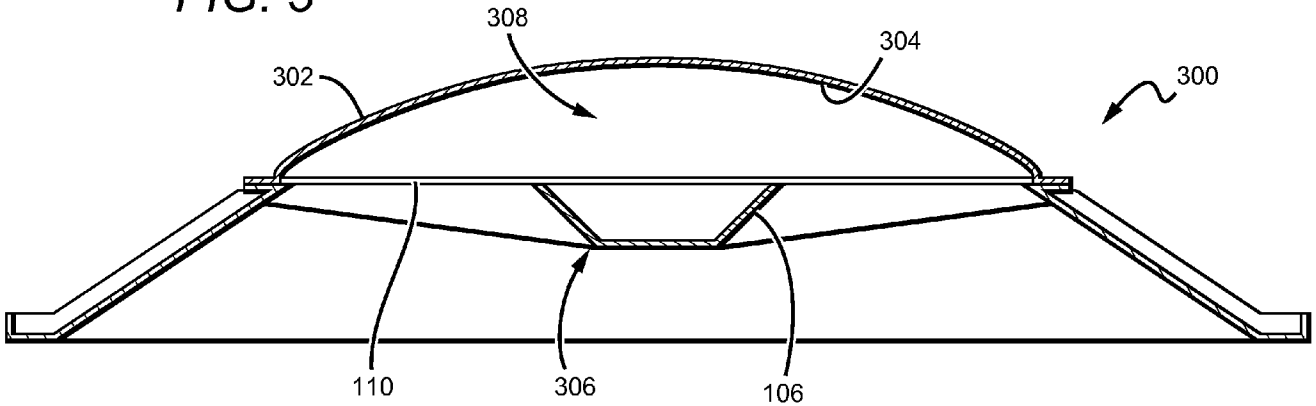
FIG. 3 is a cross-sectional view of a fixture according to an embodiment of the present invention.

Embodiments of the present invention provide a modular troffer-style fixture that is particularly well-suited for use with solid state light sources, such as LEDs. Embodiments of the troffer comprise a pan structure designed to house one or more modular light engine units within a central opening. Each light engine unit includes a reflective cup that can house several light sources on an interior mount surface. The cup is positioned proximate to a back reflector such that its open end faces a portion of the back reflector. The back reflector is shaped to define an interior chamber where light can be mixed and redirected. At least one elongated leg extends away from the reflective cup toward an edge of said back reflector. The leg(s) are used to mount the reflective cup relative to the back reflector and may also be used as a heat sink and/or an additional mount surface for light sources.

Because LED sources are relatively intense when compared to other light sources, they can create an uncomfortable working environment if not properly diffused. Fluorescent lamps using T8 bulbs typically have a surface luminance of around 21 $lm/in^2$. Many high output LED fixtures currently have a surface luminance of around 32 $lm/in^2$. Some embodiments of the present invention are designed to provide a surface luminance of not more than approximately 32 $lm/in^2$. Other embodiments are designed to provide a surface luminance of not more than approximately 21 $lm/in^2$. Still other embodiments are designed to provide a surface luminance of not more than approximately 12 $lm/in^2$.

Some fluorescent fixtures have a depth of 6 in., although in many modern applications the fixture depth has been reduced to around 5 in. In order to fit into a maximum number of existing ceiling designs, some embodiments of the present invention are designed to have a fixture depth of 5 in or less.

Embodiments of the present invention are designed to efficiently produce a visually pleasing output. Some embodiments are designed to emit with an efficacy of no less than approximately 65 lm/W. Other embodiments are designed to have a luminous efficacy of no less than approximately 76 lm/W. Still other embodiments are designed to have a luminous efficacy of no less than approximately 90 lm/W.

One embodiment of a recessed lay-in fixture for installation into a ceiling space of not less than approximately 4 $ft^2$ is designed to achieve at least 88% total optical efficiency with a maximum surface luminance of not more than 32 $lm/in^2$ with a maximum luminance gradient of not more than 5:1. Total optical efficiency is defined as the percentage of light emitted from the light source(s) that is actually emitted from the fixture. Other similar embodiments are designed to achieve a maximum surface luminance of not more than 24 $lm/in^2$. Still other similar embodiments are designed to achieve a maximum luminance gradient of not more than 3:1. In these embodiments, the actual room-side area profile of the fixture will be approximately 4 $ft^2$ or greater due to the fact that the fixture must fit inside a ceiling opening having an area of at least 4 $ft^2$ (e.g., a 2 ft by 2 ft opening, a 1 ft by 4 ft opening, etc.).

Embodiments of the present invention are described herein with reference to conversion materials, wavelength conversion materials, phosphors, phosphor layers and related terms. The use of these terms should not be construed as limiting. It is understood that the use of the term phosphor, or phosphor layers is meant to encompass and be equally applicable to all wavelength conversion materials.

It is understood that when an element is referred to as being "on" another element, it can be directly on the other element or intervening elements may also be present. Furthermore, relative terms such as "inner", "outer", "upper", "above", "lower", "beneath", and "below", and similar terms, may be used herein to describe a relationship of one element to another. It is understood that these terms are intended to encompass different orientations of the device in addition to the orientation depicted in the figures.

Although the ordinal terms first, second, etc., may be used herein to describe various elements, components, regions and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the present invention.

As used herein, the term "source" can be used to indicate a single light emitter or more than one light emitter functioning as a single source. For example, the term may be used to describe a single blue LED, or it may be used to describe a red LED and a green LED in proximity emitting as a single source. Thus, the term "source" should not be construed as a limitation indicating either a single-element or a multi-element configuration unless clearly stated otherwise.

The term "color" as used herein with reference to light is meant to describe light having a characteristic average wavelength; it is not meant to limit the light to a single wavelength. Thus, light of a particular color (e.g., green, red, blue, yellow, etc.) includes a range of wavelengths that are grouped around a particular average wavelength.

Embodiments of the invention are described herein with reference to cross-sectional view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region of a device and are not intended to limit the scope of the invention.

FIG. 1 is a perspective view from a bottom side angle of a fixture 100 according to an embodiment of the present invention. FIG. 2 is a perspective view from the bottom side of the fixture 100. The fixture 100 comprises one or more modular light engine units 102 (two in this embodiment) which fit within a reflective pan 104 that surrounds the perimeter of the light engines 102. The light engines 102 and the pan 104 are discussed in detail herein. The fixture 100 may be suspended or fit-mounted within a ceiling. The view of the fixture 100 in FIG. 1 is from an area underneath, i.e., the area that would be lit by the light sources housed within the fixture 100.

The fixture 100 may be mounted in a ceiling such that the edge of the pan 104 is flush with the ceiling plane, as shown in FIG. 1. In this configuration, the top portion of the fixture 100 would protrude into the plenum above the ceiling. The fixture 100 is designed to have a reduced height profile, so that the back end only extends a small distance (e.g., 3-5 in) into the plenum. In other embodiments, the fixture can extend farther into the plenum.

Each modular light engine unit 102 comprises a reflective cup 106 designed to house a plurality of light sources within. The cup 106 is positioned proximate to a back reflector (better shown in FIGS. 3 and 4). In this embodiment, the cup 106 is mounted with a plurality of elongated legs 108 extending away from the cup 106 toward an edge of the back reflector. In this particular embodiment, a lens plate 110 surrounds the cup 106 and encloses a space the space between the cup 106 and the back reflector, defining an interior chamber. The lens plate 110 protects the internal light sources from particulate matter and moisture and may also function as an optical element, such a diffuser or a lens, for example.

Figure 4:
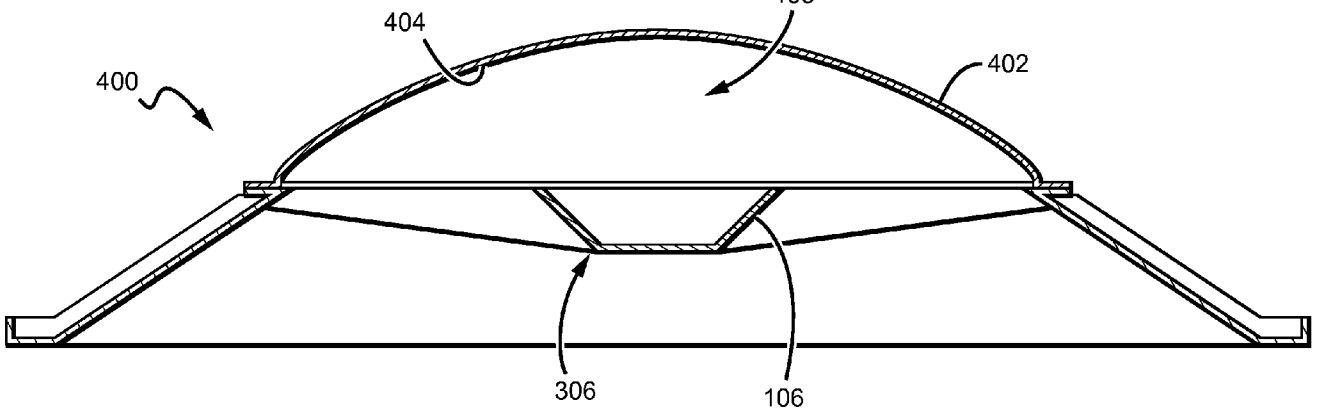
FIG. 4 is a cross-sectional view of a fixture according to an embodiment of the present invention.

FIGS. 3 and 4 are cross-sectional views of fixtures 300, 400 according to embodiments of the present invention. As shown, the modular light engines 302, 402 are mounted to fit within the pan 104. In this embodiment, the bottom edge of the pan 104 is mounted such that it is flush with the ceiling plane. It is understood that the pan 104 may take any shape necessary to achieve a particular profile so long as the pan 104 provides sufficient to support the light engine 102.

A body 302 is shaped to define an interior surface comprising a back reflector 304. The reflective cup 106 is mounted proximate to the back reflector 304. The cup 106 comprises a mount surface 306 that faces toward the back reflector 304. The mount surface 306 provides a substantially flat area where light sources (not shown) can be mounted to face toward the center region of the back reflector 304, although the light sources could be angled to face other portions of the back reflector 304. In this embodiment, a lens plate 110 is disposed between the cup 106 and the back reflector 304 and extends out to an edge of the back reflector 304. The back reflector 304, reflective cup 106, and lens plate 110 at least partially define an interior chamber 308. In some embodiments, the light sources may be mounted directly to the mount surface 306 or they may be mounted to another surface, such as a metal core board, FR4 board, printed circuit board, or a metal strip, such as aluminum, which can then be mounted to the cup 106, for example using thermal paste, adhesive and/or screws.

The fixture 400 shown in FIG. 4 is similar to the fixture 300 and shares several common elements. For convenience, like elements will retain the same reference numerals throughout the specification. The body 402 and back reflector 404 define an interior chamber 408. The interior chamber 408 of this embodiment is much deeper than the chamber 308 in the fixture 300. The depth of the chambers 308, 408 as well as the depth of the cup 106 determine the uniformity of the light distribution across the back reflectors 304, 404. Optimization between total fixture depth and uniformity can be made according to aesthetic and installation requirements.

With continued reference to FIGS. 3 and 4, the back reflectors 304, 404 may be designed to have several different shapes to perform particular optical functions, such as color mixing and beam shaping, for example. The back reflectors 304, 404 should be highly reflective in the wavelength ranges of the light sources. In some embodiments, the back reflectors 304, 404 may be 93% reflective or higher. In other embodiments they may be at least 95% reflective or at least 97% reflective.

The back reflectors 304, 404 may comprise many different materials. For many indoor lighting applications, it is desirable to present a uniform, soft light source without unpleasant glare, color striping, or hot spots. Thus, the back reflectors 304, 404 may comprise a diffuse white reflector such as a microcellular polyethylene terephthalate (MCPET) material or a Dupont/WhiteOptics material, for example. Other white diffuse reflective materials can also be used.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with LEDs emitting yellow (or blue-shifted yellow) light to yield a white light output. A diffuse reflective coating may eliminate the need for additional spatial color-mixing schemes that can introduce lossy elements into the system; although, in some embodiments it may be desirable to use a diffuse back reflector in combination with other diffusive elements. In some embodiments, the back reflector may be coated with a phosphor material that converts the wavelength of at least some of the light from the light emitting diodes to achieve a light output of the desired color point.

By using a diffuse white reflective material for the back reflectors 304, 404 and by positioning the light sources to emit first toward the back reflectors 304, 404 several design goals are achieved. For example, the back reflectors 304, 404 perform a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss) diffusers achieving max/min ratios of 5:1, 3:1, or even 2:1.

The back reflectors 304, 404 can comprise materials other than diffuse reflectors. In other embodiments, the back reflectors 304, 404 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible.

In accordance with certain embodiments of the present invention, the back reflectors 304, 404 can comprise subregions that extend from the reflective cup 106 in symmetrical fashion. In certain embodiments each of the subregions uses the same or symmetrical shape on the sides of the cup 106. In other embodiments, depending on the desired light output pattern, the back reflector subregions can have asymmetrical shape(s). Several different shapes of back reflectors are discussed in more detail herein with reference to FIGS. 12*a-d*.

In one embodiment, the lens plate 110 comprises a diffusive element. Diffusive lens plates function in several ways. For example, they can prevent direct visibility of the sources and provide additional mixing of the outgoing light to achieve a visually pleasing uniform source. However, a diffusive lens plate can introduce additional optical loss into the system. Thus, in embodiments where the light is sufficiently mixed by the back reflector or by other elements, a diffusive lens plate may be unnecessary. In such embodiments, a transparent glass lens plate may be used, or the lens plates may be removed entirely. In still other embodiments, scattering particles may be included in the lens plate 110. In embodiments using a specular back reflector, it may be desirable to use a diffuse lens plate.

Diffusive elements in the lens plate 110 can be achieved with several different structures. A diffusive film inlay can be applied to the top- or bottom-side surface of the lens plate 110. It is also possible to manufacture the lens plate 110 to include an integral diffusive layer, such as by coextruding the two materials or insert molding the diffuser onto the exterior or interior surface. A clear lens may include a diffractive or repeated geometric pattern rolled into an extrusion or molded into the surface at the time of manufacture. In another embodiment, the lens plate material itself may comprise a volumetric diffuser, such as an added colorant or particles having a different index of refraction, for example.

In other embodiments, the lens plate 110 may be used to optically shape the outgoing beam with the use of microlens structures, for example. Many different kinds of beam shaping optical features can be included integrally with the lens plate 110.

Figure 5:
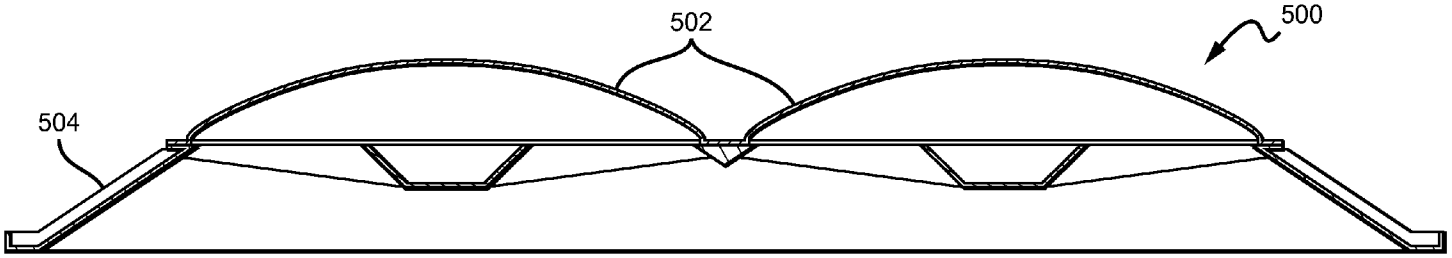
FIG. 5 is a cross-sectional view of a fixture according to an embodiment of the present invention.

FIG. 5 is a cross-sectional view of a fixture 500 according to an embodiment of the present invention. As shown, the light engines 502 are modular such that more than one can fit within a single pan 504. The light engines 502 have a square footprint, but it is understood that many different footprint designs can be used. Square light engines can easily be arranged within rectangular spaces such as those that are commonly found in industrial and commercial spaces. Here, the modular light engines 502 are arranged within the pan 504 in a 2×1 linear array. However, the light engines 502 can be configured within the pan 504 in several ways, including linear arrangements or in a row/column arrays. In other embodiments, the light engines 502 can be arranged in a staggered array (e.g., caddy-corner to one another in a 2×2 space). Many different modular arrangements are possible.

In some embodiments, such as the one shown in FIG. 5, light engines 502 having a square footprint are used. The square light engine 502 may be used as the basic building unit for constructing different sizes of fixtures as mentioned above. Because the mechanical components of the basic unit are identical, a manufacturer can leverage economies of scale and standardized assembly methods to fabricate many different sizes of fixtures in a cost-efficient manner. Also, the light engine units 502 can be manufactured in a separate facility from the rest of the fixture 500, allowing for off-shore or low-cost labor rate sourcing.

Figure 6A:
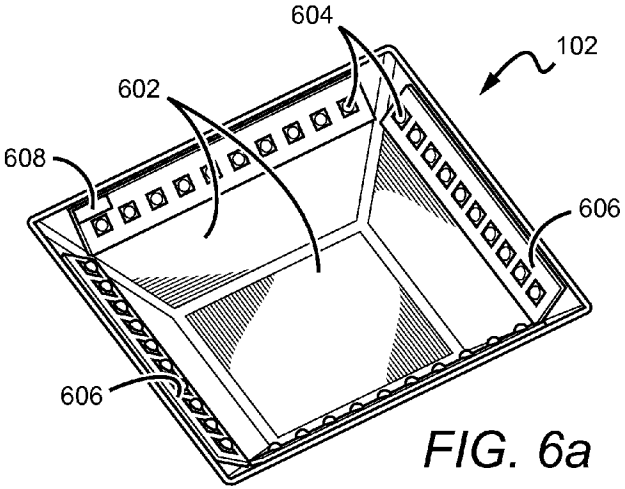
FIG. 6*a* is a perspective view of a reflective cup that may be used in fixtures according to embodiments of the present invention.

FIG. 6*a* is a perspective view of a reflective cup 106 that may be used in fixtures according to embodiments of the present invention. The cup 106 comprises several internal mount surfaces 602. A plurality of light sources 604 (e.g., LEDs) are mounted on the internal mount surfaces 602. In this particular embodiment, the cup 106 is shaped as a truncated pyramid with the light sources 604 mounted on the side mount surfaces 602 such that they are aimed toward the back reflector (not shown). The light sources may also be mounted on the bottom mount surface in some embodiments. The cup 106 itself may be shaped in various ways to shape the light as it escapes into the interior chamber. For example, cup mount surfaces may be angled differently to accommodate back reflectors having a particular shape such that the light is distributed across the back reflector in a certain way. Here, the cup 106 has a square footprint. In some embodiments, the reflective cup may have a circular footprint, for example. Many different cup shapes are possible.

The cup 106 performs the dual function of providing a reflective mount surface 602 for the light sources 604 while at the same time functioning as a heat sink to draw thermal energy away from the light sources 604 and facilitate its dissipation into the surrounding ambient. In this embodiment, the light sources 604 are disposed on light strips 606. A control circuit 608 may be integrated onto the light strips 606 or it may be exposed eternally to the cup or externally to the entire fixture. The cup 106 can be fabricated using many reflective thermally conductive materials, such as aluminum, for example. Using one possible fabrication method, the cup 106 may be stamped from an aluminum sheet, with one suitable thickness range for the sheet being 1-2 mm thick.

Figure 6B:
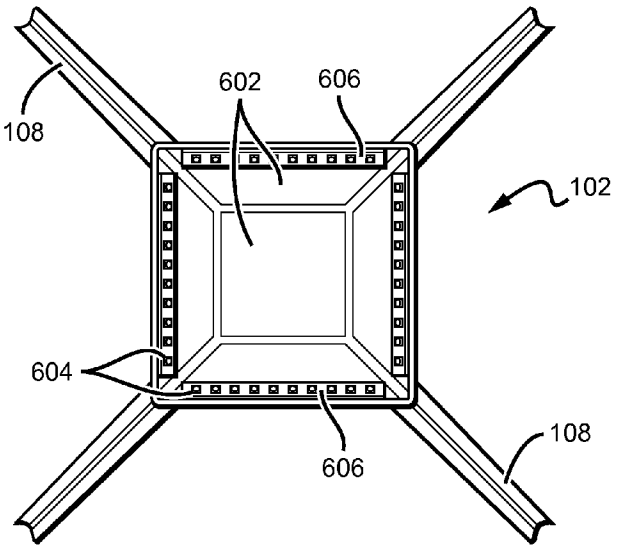
FIG. 6*b* is a top perspective view of a reflective cup that may be used in fixtures according to embodiments of the present invention.

FIG. 6*b* is a top perspective view of the cup 106. In this view, the elongated legs 108 are shown extending away from the cup 106 toward an edge of the back reflector (not shown). Like the cup 106, the legs should be constructed from a reflective material that is highly thermally conductive, such as aluminum, for example. The legs 108 may include white reflective or diffusive backers to keep light from becoming trapped in the legs 108 rather than escaping through the lens plate 110. The legs 108 provide structural support for the cup, allowing it to be positioned a certain distance from the back reflector. The legs 108 also provide a thermal path from the cup 106 to the pan structure. In some embodiments the legs 108 may house wires for powering the light sources with an external power source.

The legs 108 may be stamped from an aluminum sheet (bulk conductivity ~200 W/m*K), with one acceptable thickness range being 0.25-0.5 mm. Other embodiments may include legs fabricated with several different processes and materials, including: a die cast or pressure cast process using aluminum (bulk conductivity ~80-120 W/m*K); stamped steel sheet (bulk conductivity ~50 W/m*K); thermally conductive plastic (bulk conductivity ~3-20 W/m*K); and thermally conductive thermoset (bulk conductivity ~2-10 W/m*K). Other materials and process are also possible. Thicker materials have the capacity to dissipate more heat; however, added thickness may increase optical loss due to absorption.

The lighting fixture 100 comprises a reflective cup 106 that is connected to the pan 104 with four elongated legs 108. In other embodiments, the cup 106 may be connected to the pan 104 with more or fewer than four legs. One embodiment uses only a single leg; another embodiment uses eight legs. Increasing the number of legs provides additional heat dissipation capacity at the cost of reduced optical efficiency due to absorption.

The legs 108 provide a level of mechanical shielding, while still allowing the fixture 100 to retain a low profile. A suitable range for the depth of the legs 108 (i.e., the vertical distance into the interior chamber) is 0.5-2 in.

In one method of fabrication, the cup 106 and the legs 108 can be attached with a final stamping step. By using a stamping process to fabricate the cup 106 and the legs 108, material usage is minimized, saving 25-50% of the cost of a comparable extruded heat sink structure. Highly reflective white plastic components with mechanical attachment features may be used to allow the components to be joined using snap-fit structures for easy assembly and disassembly.

Figure 7:
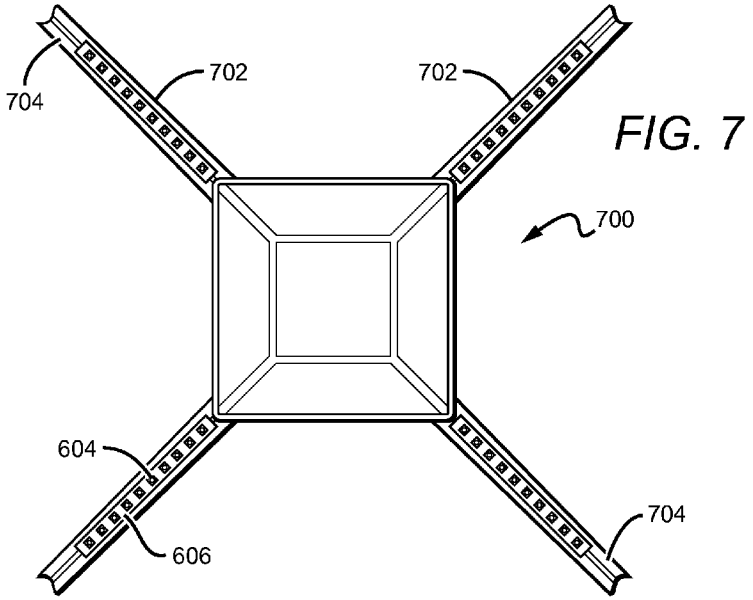
FIG. 7 is a top side perspective view of a reflective cup that may be used in fixtures according to embodiments of the present invention.

FIG. 7 is a top side perspective view of another reflective cup 700 that may be used in fixtures according to embodiments of the present invention. In this particular embodiment, a plurality of elongated legs 702 supports the cup 700 with each leg 702 comprising a reflective back side mount surface 704. As shown, the light sources 604 are on light strips 606 which are mounted on the back side mount surfaces 704 of the legs 702. In some embodiments, the legs 702 may also comprise diffusive covers over the light sources 604. The light sources 604 initially emit light toward the back reflector (not shown). The light strips 606 are in good thermal communication with the legs 702 which provide additional surface area and a thermal path to the pan structure, facilitating heat dissipation from the light sources 604 into the ambient environment. Thus, in various embodiments, the light sources 604 can be disposed in the cup 106, on the elongated legs 704, or on both.

Figure 8A:
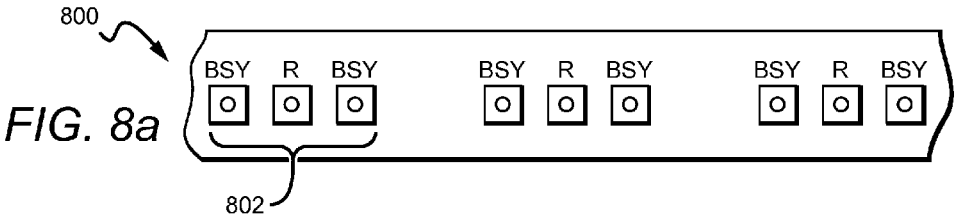
FIG. 8*a* is a top plan view of a light strip that may be used in embodiments of the present invention.
Figure 8B:
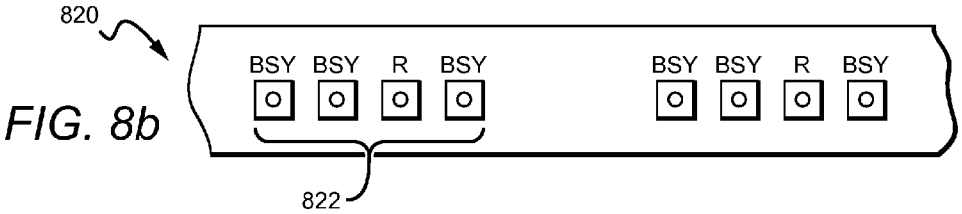
FIG. 8*b* is a top plan view of a light strip that may be used in embodiments of the present invention.
Figure 8C:
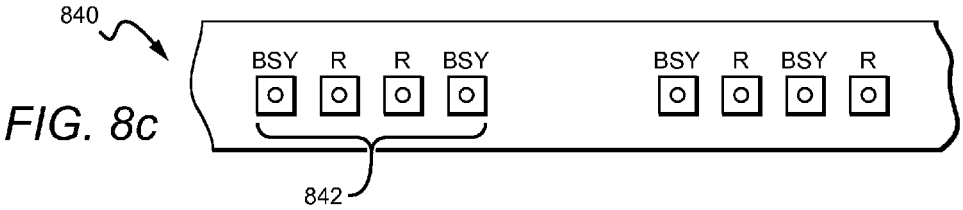
FIG. 8*c* is a top plan view of a light strip that may be used in embodiments of the present invention.

In several of the fixture embodiments described herein, the light sources 604 are arranged on light strips 606 which may be disposed around the perimeter of the cup 106 and/or along the back side of the elongated legs 702. FIGS. 8*a-c* show a top plan view of portions of several light strips 800, 820, 840 that may be used to mount multiple LEDs to the cup 700 and legs 704. Although LEDs may be used as the light sources in various embodiments described herein, it is understood that other light sources, such as laser diodes for example, may be substituted in as the light sources in other embodiments of the present invention.

Many industrial, commercial, and residential applications call for white light sources. The troffer 100 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range between 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The lighting strips 800, 820, 840 each represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 800 includes clusters 802 of discrete LEDs, with each LED within the cluster 802 spaced a distance from the next LED, and each cluster 802 spaced a distance from the next cluster 802. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 8*a* uses a series of clusters 802 having two blue-shifted-yellow LEDs ("BSY") and a single red LED ("R"). Once properly mixed the resultant output light will have a "warm white" appearance.

The lighting strip 820 includes clusters 822 of discrete LEDs. The scheme shown in FIG. 8*b* uses a series of clusters 822 having three BSY LEDs and a single red LED. This scheme will also yield a warm white output when sufficiently mixed.

The lighting strip 840 includes clusters 842 of discrete LEDs. The scheme shown in FIG. 8*c* uses a series of clusters 842 having two BSY LEDs and two red LEDs. This scheme will also yield a warm white output when sufficiently mixed.

The lighting schemes shown in FIGS. 8*a-c* are meant to be exemplary. Thus, it is understood that many different LED combinations can be used in concert with known conversion techniques to generate a desired output light color.

In other embodiments, LEDs may be centralized in given area using a chip-on-board (COB) configuration. FIG. 9 is a top perspective view of a COB element 900 that may be used in fixtures according to embodiments of the present invention. The COB element 900 comprises several LEDs of first color 902 and LEDs of a second color 904 all mounted to a thermally conductive board 906. On-board elements provide circuitry that can power multiple high voltage LEDs. The element 900 may be easily mounted to many surfaces within the fixture. COB provides several advantages over traditional individually packaged LEDs. One advantage is the removal of a thermal interface from between the chip and the ambient environment. A substrate element, which may be made of alumina or aluminum nitride, may be removed as well resulting in a cost saving. Process cost may also be reduced as the singulation process necessary to separate individual LED dice is eliminated from the work stream.

FIG. 10 shows a top perspective view of a reflective cup 1000 that may be used in fixtures according to embodiments of the present invention. A chip-on-board element 900 is mounted to the bottom interior surface of the cup 1000 such that the LEDs emit toward the back reflector (not shown). The chip-on-board element 900 is in good thermal communication with the cup 1000 such that heat from the LEDs is easily transferred through the cup 1000 into the ambient environment. In fixture embodiments where the light sources are clustered together in the reflective cup, such as that shown in FIG. 10, the total area of metal core printed circuit board (MCPCB) or the like can be minimized, reducing the overall cost of the fixture.

Additionally, because the LEDs are centrally clustered in close proximity to each other in the reflective cup, the total number of LEDs can be reduced without sacrificing color mixing. Thus, embodiments having the centrally clustered LEDs can take advantage of ever-improving LED efficacy that results in fewer total LEDs necessary for a given output.

FIG. 11 is a cross-sectional view of a reflective cup 1100 that may be used in fixtures according to embodiments of the present invention. Many modern applications require high voltage LEDs for increased output and brightness. In such applications, a transmissive cover 1102 may function as a flame barrier (e.g., glass or a UL94 5VA rated transparent plastic) which is required to cover high voltage LEDs. Centrally located LED clusters reduce cost as the material necessary for the flame barrier cover 1102 is reduced. If high voltage LEDs are used, then an economically efficient high voltage (boost) power supply may be used. The cover 1102 may also function as a lens to shape/convert/diffuse the light as it emanates from the sources but before it interacts with the back reflector. Any of these optional elements or any combination of these elements may be used in reflective cups designed for embodiments of the lighting fixtures disclosed herein.

Figure 12A:
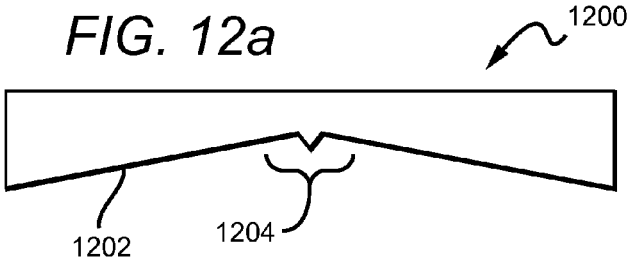
FIG. 12*a* is a cross-sectional view of a back reflector according to an embodiment of the present invention.
Figure 12B:
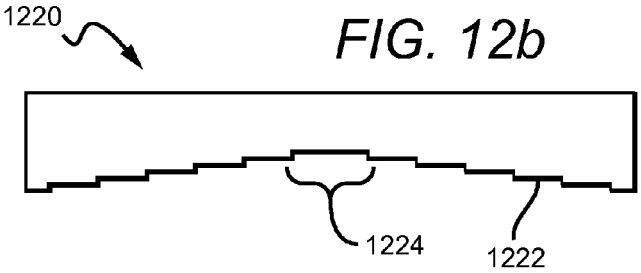
FIG. 12*b* is a cross-sectional view of a back reflector according to an embodiment of the present invention.
Figure 12C:
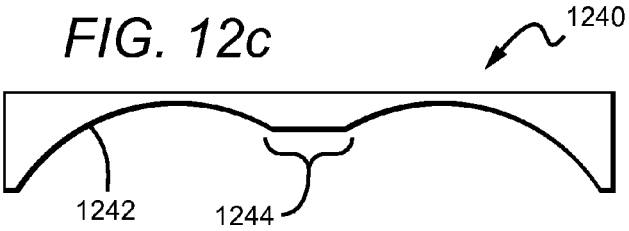
FIG. 12*c* is a cross-sectional view of a back reflector according to an embodiment of the present invention.
Figure 12D:
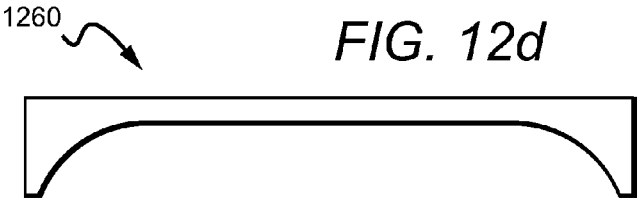
FIG. 12*d* is a cross-sectional view of a back reflector according to an embodiment of the present invention.

FIGS. 12*a-d* are cross-sectional views of several back reflectors that may be used in lighting fixtures according to embodiments of the present invention. The back reflectors 304, 404 in the light engine units 300, 400 include side regions having a parabolic shape; however, many other shapes are possible. The back section 1200 of FIG. 12*a* features flat side regions 1202 and a center region 1204 defined by a vertex. FIG. 12*b* features corrugated or stair-step side regions 1222 and a flat center region 1224. The step size and the distance between steps can vary depending on the intended output profile. In some embodiments the corrugation may be implemented on a microscopic scale. FIG. 12*c* shows a back reflector 1240 having parabolic side regions 1242 and a flat center region 1244. FIG. 12*d* shows a back reflector 1260 having a curvilinear contour. It is understood that geometries of the back reflectors 1200, 1220, 1240, 1260 are exemplary, and that many other shapes and combinations of shapes are possible. The shape of the back reflector should be chosen to produce the appropriate reflective profile for an intended output.

FIG. 13 is a top perspective view of a light engine 1300 that may be used in fixtures according to embodiments of the present invention. In this particular embodiment, a plurality of heat pipes 1302 extends away from the central reflective cup 1304. Heat pipes are known in the art and therefore only briefly discussed herein. The heat pipes 1302 may be thermally coupled to an external structure such as a pan 1306. Other types of thermally conductive structures can also be used to create a thermal path from the cup 1304 to the pan 1306.

FIG. 14 is a top perspective view of a reflective cup 1400 that may be used in fixtures according to embodiments of the present invention. The reflective cup 1400 is similar to the cup 700; however, in this particular embodiment a driver circuit 1402 is mounted to the bottom interior surface of the cup 1400. The driver circuit 1402 is in good thermal communication with the cup 1400 such that heat from the circuit is easily transferred through the cup 1400 into the ambient environment. The driver circuit 1402 comprises circuit elements that drive the LEDs 1404 that are arranged in the cup 1400. It is understood that element representing the driver circuit 1402 is merely a placeholder for purposes of identifying one surface where the driver circuit 1402 may be disposed; thus, it is not an accurate representation of an actual driver circuit. Driver circuits are known in the art, and many different driver circuits may be used in embodiments of the fixtures disclosed herein. In this embodiment the LEDs 1404 are arranged around the periphery of the cup 1400. The LEDs can also be arranged on any interior surface of the cup 1400, including on the bottom surface around the driver circuit 1402.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain configurations thereof, other versions are possible. Therefore, the spirit and scope of the invention should not be limited to the versions described above.

We claim:

1. A light engine unit, comprising:

a reflective cup comprising an interior mount surface;

a back reflector proximate to said reflective cup, at least a portion of said back reflector facing said mount surface, said back reflector shaped to define an interior chamber;

at least two elongated legs extending away from said reflective cup toward an edge of said back reflector; and a plurality of light emitting diodes (LEDs) on the perimeter of said interior mount surface.

2. The light engine unit of claim 1, wherein said reflective cup and said at least two legs provide a thermal path from said interior mount surface to the ambient environment.

3. The light engine unit of claim 1, further comprising at least one light source on said reflective cup mount surface, said light source aimed to emit toward said back reflector.

4. The light engine unit of claim 1, further comprising a lens plate that surrounds said reflective cup and encloses said chamber.

5. The light engine unit of claim 4, wherein said lens plate is diffusive.

6. The light engine unit of claim 1, further comprising at least one cluster of light emitting diodes (LEDs) on said reflective cup mount surface, said light source aimed to emit toward said back reflector.

7. The light engine unit of claim 6, wherein said LEDs are chip-on-board structures.

8. The light engine unit of claim 6, where said at least one cluster comprises high voltage LEDs.

9. The light engine unit of claim 1, further comprising a flame barrier over said reflective cup.

10. The light engine unit of claim 6, said at least one cluster of LEDs comprising red LEDs and blue-shifted yellow LEDs.

11. The light engine unit of claim 1, said reflective cup comprising a thermally conductive material.

12. The light engine unit of claim 1, said at least two legs comprising a thermally conductive material.

13. The light engine unit of claim 1, said at least two legs comprising a reflective back surface facing said back reflector.

14. The light engine unit of claim 1, said at least two legs comprising a back side mount surface facing said back reflector.

15. A light engine unit, comprising:

a reflective cup comprising an interior mount surface;

a back reflector proximate to said reflective cup, at least a portion of said back reflector facing said mount surface, said back reflector shaped to define an interior chamber; and at least one elongated leg extending away from said reflective cup toward an edge of said back reflector, said at least one leg comprising a back side mount surface facing said back reflector; and at least one light source on said back side mount surface of said at least one leg.

16. A light engine unit, comprising:

a reflective cup comprising an interior mount surface;

a back reflector proximate to said reflective cup, at least a portion of said back reflector facing said mount surface, said back reflector shaped to define an interior chamber; and at least one elongated leg extending away from said reflective cup toward an edge of said back reflector, said at least one leg comprising a back side mount surface facing said back reflector wherein said at least one leg further comprising a diffusive cover over said back side mount surface.

17. The light engine unit of claim 1, said at least two legs housing conductive structures that provide a conductive path from an outside source to said reflective cup.

18. The light engine unit of claim 1, said at least two legs comprising a heat pipe.

19. The light engine unit of claim 1, said reflective cup comprising the shape of a truncated pyramid.

20. The light engine unit of claim 1, wherein said light engine unit comprises a square footprint.

21. The light engine unit of claim 1, further comprising a driver circuit on said interior mount surface of said reflective cup.

22. A light fixture, comprising:

a pan structure defining a central opening;

a light engine unit sized to fit within said central opening, said light engine comprising:

a reflective cup comprising an interior mount surface;

a back reflector proximate to said reflective cup, at least a portion of said back reflector facing said mount surface, said back reflector shaped to define an interior chamber;

a plurality of elongated legs extending away from said reflective cup toward said pan; and a plurality of light emitting diodes (LEDs) on the perimeter of said interior mount surface, said LEDs aimed to emit toward said back reflector; and a control circuit for controlling said LEDs, said control circuit on said interior mount surface.

23. The light fixture of claim 22, wherein said reflective cup and said at least one leg provide a thermal path from said interior mount surface to the ambient environment.

24. The light fixture of claim 22, further comprising at least one light source on said reflective cup mount surface, said light source aimed to emit toward said back reflector.

25. The light fixture of claim 22, further comprising a lens plate that surrounds said reflective cup and encloses said chamber.

26. The light fixture of claim 25, wherein said lens plate is diffusive.

27. The light fixture of claim 22, wherein said LEDs are chip-on-board structures.

28. The light fixture of claim 22, where said LEDs comprise high voltage LEDs.

29. The light fixture of claim 22, further comprising a flame barrier over said reflective cup.

30. The light fixture of claim 22, said LEDs comprising red LEDs and blue-shifted yellow LEDs.

31. The light fixture of claim 22, said reflective cup comprising a thermally conductive material.

32. The light fixture of claim 22, said legs comprising a thermally conductive material.

33. The light fixture of claim 22, said legs comprising a reflective back surface facing said back reflector.

34. The light fixture of claim 22, said legs comprising a back side mount surface facing said back reflector.

35. The light fixture of claim 34, further comprising a plurality of LEDs on said back side mount surface of said legs.

36. The light fixture of claim 34, each of said legs comprising a diffusive cover over said back side mount surface.

37. The light fixture of claim 22, said legs housing conductive structures that provide a conductive path from an outside source to said reflective cup.

38. The light fixture of claim 22, said legs comprising a heat pipe.

39. The light fixture of claim 22, said reflective cup comprising the shape of a truncated pyramid.

40. The light fixture of claim 22, wherein said light engine unit comprises a square footprint.

41. The light fixture of claim 22, further comprising a control circuit on said interior surface of said reflective cup.

42. A modular light fixture, comprising:

a pan structure defining a central opening; and a plurality of light engine units sized to removably mount within said central opening, each of said light engines comprising:

a reflective cup comprising an interior mount surface;

a back reflector proximate to said reflective cup, at least a portion of said back reflector facing said mount surface, said back reflector shaped to define an interior chamber;

at least two elongated legs extending away from said reflective cup toward an edge of said back reflector; and a plurality of light emitting diodes (LEDs) on the perimeter of said interior mount surface.

* * * * *